US011346174B1

(12) United States Patent
Baugh

(10) Patent No.: US 11,346,174 B1
(45) Date of Patent: May 31, 2022

(54) METHOD FOR INTEGRATING CHOKE LINES, KILL LINES, AND HYDRAULIC CONTROL LINES INTO A MANDREL

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 17/386,285

(22) Filed: Jul. 27, 2021

(51) Int. Cl.
*E21B 33/035* (2006.01)
*E21B 33/038* (2006.01)

(52) U.S. Cl.
CPC ..... *E21B 33/0355* (2013.01); *E21B 33/0385* (2013.01); *E21B 33/0387* (2020.05)

(58) Field of Classification Search
CPC ..... E21B 33/0355; E21B 33/0385; E21B 33/0387
See application file for complete search history.

(56) References Cited

U.S. PATENT DOCUMENTS 4,411,454 A 10/1983 Naylor
4,460,156 A 1/1984 Hazelrigg
4,496,172 A 1/1985 Walker
4,516,795 A 5/1985 Baugh
5,052,941 A * 10/1991 Hernandez-Marti ..... E21B 33/0385 439/194
6,609,734 B1 8/2003 Baugh
6,679,472 B2 1/2004 Baugh
8,607,879 B2 * 12/2013 Reynolds ..... E21B 33/035 166/351

OTHER PUBLICATIONS

I filed a provisional application Jun. 29, 2020 as EFS ID 40134555 and U.S. Appl. No. 63/057,965 and intended to link this application to it, but could not figure out how to do it.

* cited by examiner

*Primary Examiner* — Matthew R Buck

(57) ABSTRACT

In a subsea blowout preventer stack system with a lower marine riser package with a lower marine riser connector and choke and/or kill lines, and a lower blowout preventer stack with a mandrel on the upper end and choke and/or kill lines connection to choke and kill valves, a method of porting the choke, kill lines, hydraulic lines and electrical lines vertically through the wall of the lower blowout preventer stack mandrel.

17 Claims, 4 Drawing Sheets

METHOD FOR INTEGRATING CHOKE LINES, KILL LINES, AND HYDRAULIC CONTROL LINES INTO A MANDREL

TECHNICAL FIELD

This invention relates to the method of integrating the choke and kill lines, hydraulic control fluid paths, and electrical signal paths into the lower marine riser connector and the mandrel at the top of the lower blowout preventer stack, thereby eliminating independent choke and kill connectors, hydraulic control fluid stab plates, and electrical connections.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater offshore drilling requires that a vessel at the surface be connected through a drilling riser and a large blowout preventer stack to the seafloor wellhead. The seafloor wellhead is the structural anchor piece into the seabed and the basic support for the casing strings which are placed in the well bore as long tubular pressure vessels. During the process of drilling the well, the blowout preventer stack on the top of the subsea wellhead provides the second level of pressure control for the well. The first level being provided by the weighted drilling mud within the bore.

During the drilling process, weighted drilling mud circulates down a string of drill pipe to the drilling bit at the bottom of the hole and back up the annular area between the outside diameter of the drill pipe and the inside diameter of the drilled hole or the casing, depending on the depth.

Coming back up above the blowout preventer stack, the drilling mud will continue to travel back outside the drill pipe and inside the drilling riser, which is much large than the casing. The drilling riser has to be large enough to pass the casing strings run into the well, as well as the casing hangers which will suspend the casing strings. The bore in a contemporary riser will be at least twenty inches in diameter. It additionally has to be pressure competent to handle the pressure of the weighed mud, but does not have the same pressure requirement as the blowout preventer stack itself.

As wells are drilled into progressively deeper and deeper formations, the subsurface pressure and therefore the pressure which the blowout preventer stack must be able to withstand becomes greater and greater. This is the same for drilling on the surface of the land and subsea drilling on the surface of the seafloor. Early subsea blowout preventer stacks were of a 5,000 p.s.i. working pressure, and over time these evolved to 10,000 and 15,000 p.s.i. working pressure. As the working pressure of components becomes higher, the pressure holding components naturally become both heavier and taller. Additionally, in the higher pressure situations, redundant components have been added, again adding to the height. The 15,000 blowout preventer stacks have become in the range of 800,000 lbs. and 80 feet tall. This provides enormous complications on the ability to handle the equipment as well as the loadings on the seafloor wellhead. In addition to the direct weight load on the subsea wellheads, side angle loadings from the drilling riser when the surface vessel drifts off the well centerline are an enormous addition to the stresses on both the subsea wellhead and the seafloor formations.

When the blowout preventer stack working pressure is increased to 20,000 p.s.i. some estimates of the load is that it increases from 800,000 to 1,200,000 lbs. The height also increases, but how much is unclear at this time but it will likely approach 100 feet in height.

Another complication is that the choke and kill lines which come down as a part of the drilling riser must pass through the interface between the lower marine riser package and the lower blowout preventer stack to reach the entrance point to the bore of the blowout preventer stack. These have placed within the structure outside the lower marine riser connector. These have primarily been stab subs which require accurate alignment for engagement and are of three to five feet from the centerline of the lower marine riser connector and induce a high moment on the blowout preventer stack structures and on the lower marine riser connector itself or of a connector type themselves which cancel the moment on the structures, but can destroy the structures if they do not release properly when the lower marine riser connector is released. Additionally An alternate choke and kill connector design is shown in U.S. Pat. No. 6,679,472 which attempts to resolve the might moment forces problem and the connector locking problem by providing a pressure balanced non-locking choke and kill stab.

Another complication is that there are two identical redundant control pods typically landed on the lower marine riser package, typically a yellow one and a blue one. Each of these require a hydraulic and/or electrical interface between the lower marine riser package and the lower blowout preventer stack.

All of these connection requirements lead to a more complex and heavier blowout preventer stack system.

BRIEF SUMMARY OF THE INVENTION

The object of this invention is to reduce the size, weight, and complexity of subsea blowout preventer stacks.

A second object of this invention is to eliminate the need for choke and kill connectors between the lower marine riser package and the lower blowout preventer stack.

A third object of this invention is eliminate the need for a hydraulic stab plate between the lower marine riser package and the lower blowout preventer stack.

Another object of this invention is integrate the choke and kill flow paths into the connector/mandrel interface between the lower marine riser package and the lower blowout preventer stack.

Another object of this invention is integrate the hydraulic control fluid flow paths into the connector/mandrel interface between the lower marine riser package and the lower blowout preventer stack.

Another object of this invention is integrate the electrical connection paths into the connector/mandrel interface between the lower marine riser package and the lower blowout preventer stack.

BRIEF DESCRIPTION OF THE DRAWINGS

FIG. 3 is a perspective view of a subsea wellhead housing which the blowout preventer stack of this invention would land on.

DETAILED DESCRIPTION OF THE INVENTION

Figure 1:
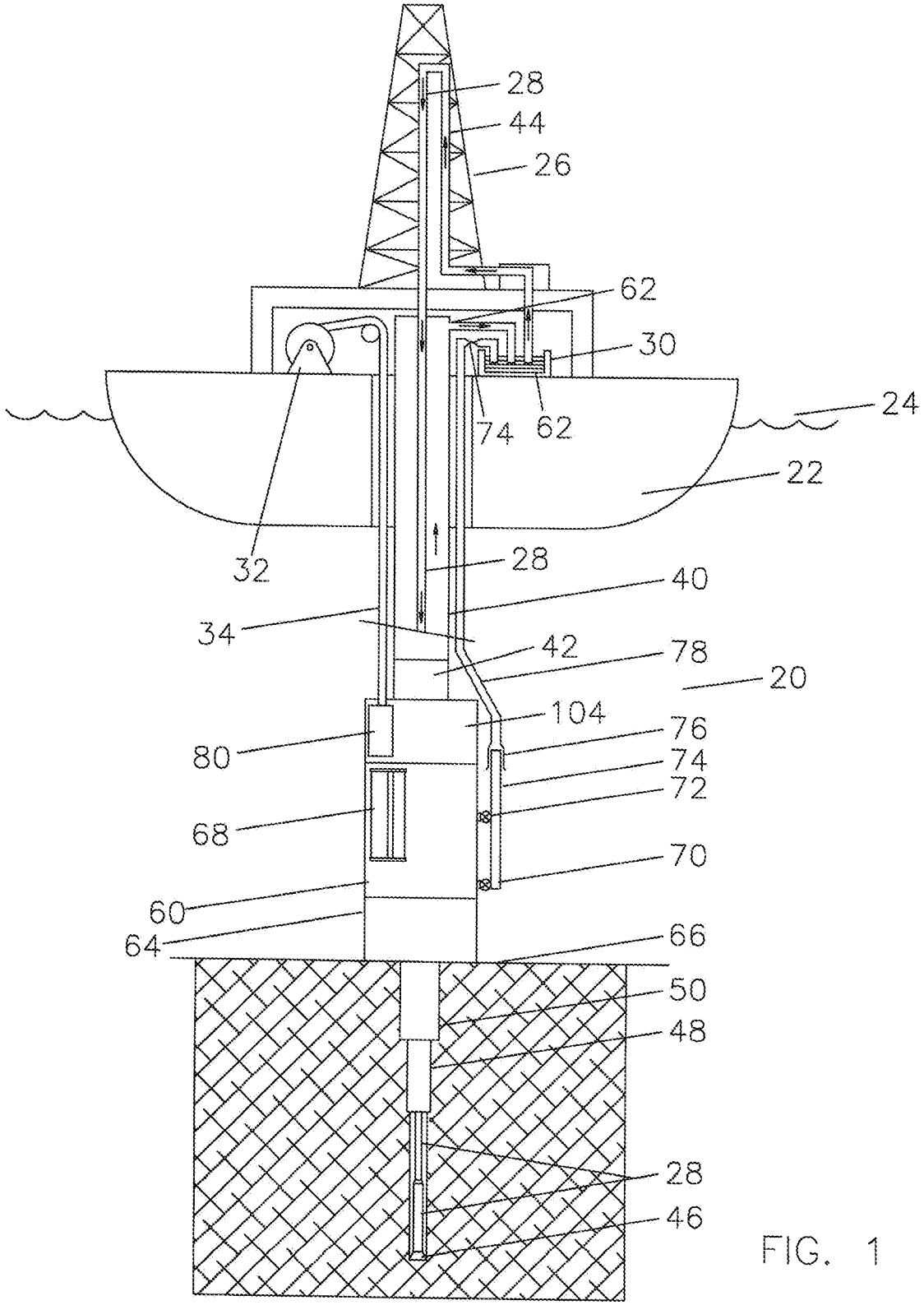
FIG. 1 is a view of a contemporary deep-water riser system.

Referring now to FIG. 1, a view of a system 20 which might use the present invention is shown. It shows a floating vessel 22 on a body of water 24 and having a derrick 26. Drill pipe 28, drilling mud system 30, control reel 32, and control cable 34 are shown. A riser system 40 including a flex joint 42 is shown. During drilling the drilling mud circulated from the drilling mud system 30, up the standpipe 44, down the drill pipe 28, through the drill bit 46, back up through the casing strings 48 and 50, through the blowout preventer stack 60, up thru the riser system 40, and out the bell nipple at 62 back into the mud system 30.

Blowout preventer stack 60 is landed on a subsea wellhead system 64 landed on the seafloor 66. The blowout preventer stack 60 includes pressurized accumulators 68, kill valves 70, choke valves 72, choke and kill lines 74, choke and kill connectors 76, choke and kill flex means 78, and control pods 80.

Figure 2:
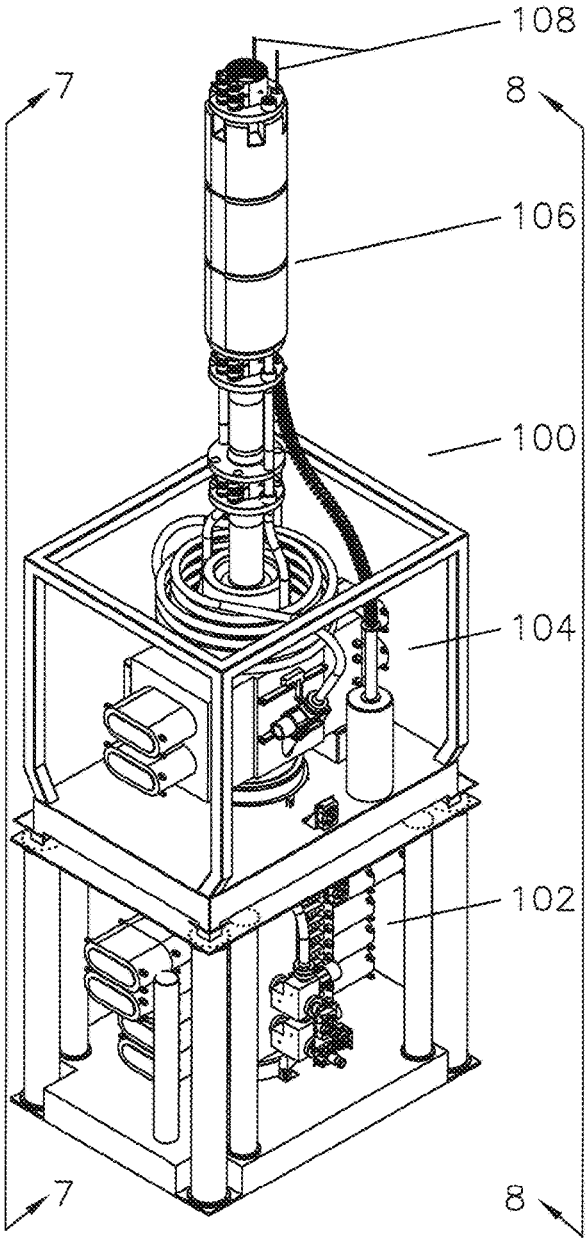
FIG. 2 is a perspective view of a blowout preventer stack utilizing the features of this invention.

Referring now to FIG. 2, the seafloor drilling system 100 comprises a lower blowout preventer stack 102, a lower marine riser package 104, a drilling riser joint 106, and control cables 108.

Figure 3:
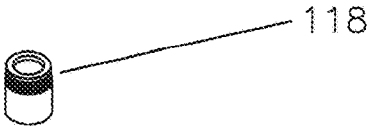

Referring now to FIG. 3, a subsea wellhead is shown which the seafloor drilling system lands on. It is the unseen upper portion of the subsea wellhead system 64 shown in FIG. 1.

Figure 4:
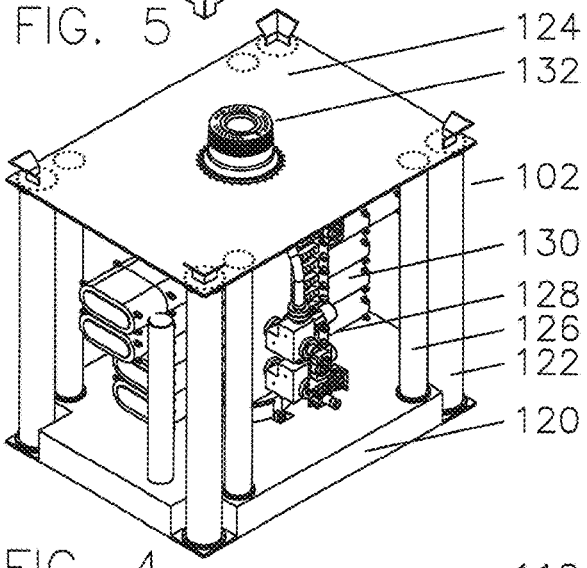
FIG. 4 is a perspective view of the lower portion of the blowout preventer stack of FIG. 2, generally called the lower BOP stack.

Referring now to FIG. 4, the lower blowout preventer stack 102 comprises a lower structural section 120, vertical support bottle 122, and upper structural section 124, accumulators 126, choke and kill valves 128, blowout preventers 130 and an upper mandrel 132 which will be the connection point for the lower marine riser package.

Figure 5:
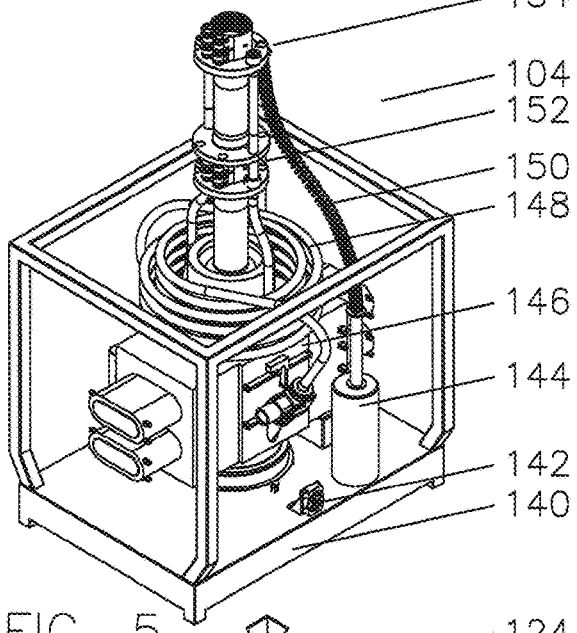
FIG. 5 is a perspective view of the upper portion of the blowout preventer stack of FIG. 2, generally called the lower marine riser package or LMRP.

Referring now to FIG. 5 the lower marine riser package 104 is shown comprising a lower marine riser package structure 140, an interface 142 for a remotely controlled vehicle (ROV), annular blowout preventers 146, choke and kill flex loops 148, a flexible passageway 150, a riser connector 152, and an upper half of a riser connector 154.

Figure 6:
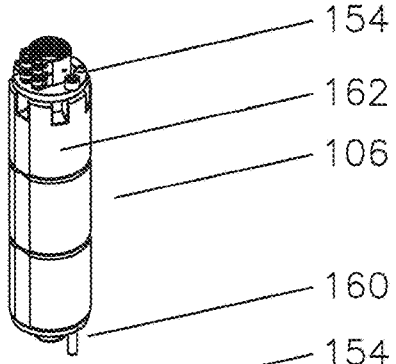
FIG. 6 is a perspective view of a section of the drilling riser which will be used to lower the blowout preventer stack.

Referring now to FIG. 6, a drilling riser joint 106 is shown having a lower half of a riser connector 160, a upper half of a riser connector 154, and buoyancy sections 162.

Figure 7:
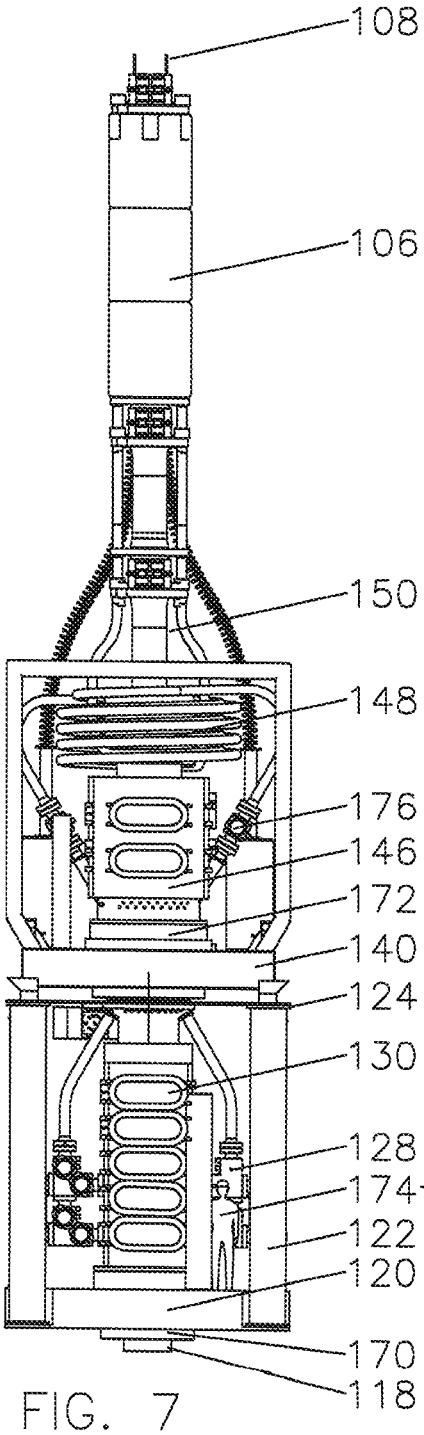
FIG. 7 is a view of the blowout preventer stack of FIG. 2, taken along lines "7-7.

Referring now to FIG. 7, is a view of seafloor drilling system 100 taken along lines "7-7" of FIG. 1 showing wellhead connector 170, lower marine riser connector 172, a man 174 for size perspective, and choke and kill valves 176.

Figure 8:
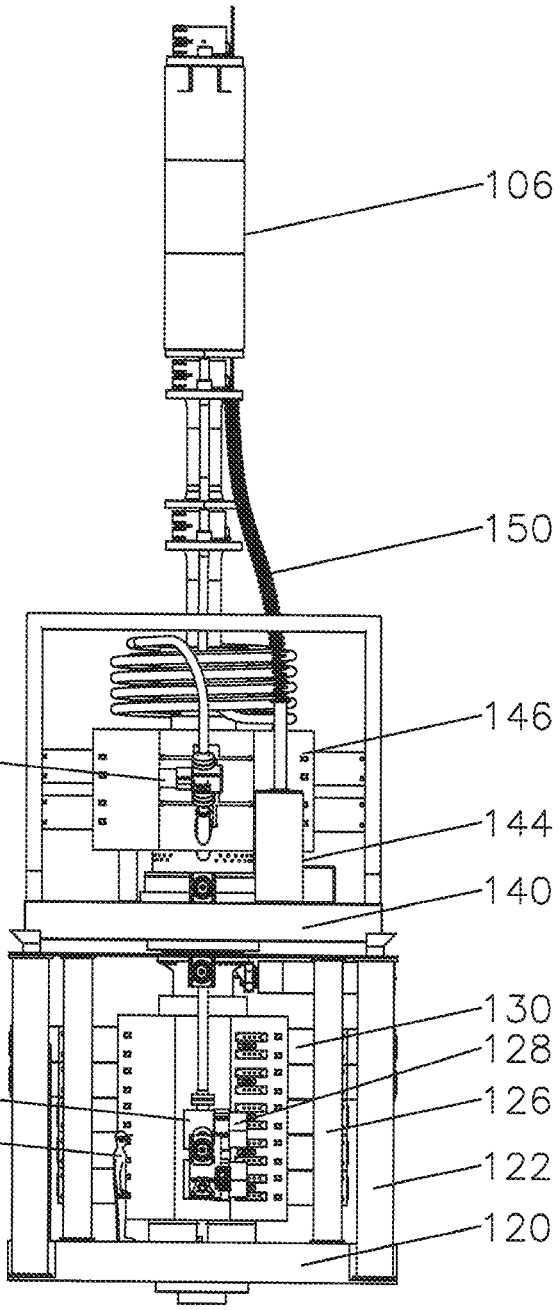
FIG. 8 is a view of the blowout preventer stack of FIG. 2, taken along lines "8-8.

Referring now to FIG. 8, is a view of seafloor drilling system 100 taken along lines "8-8" of FIG. 1.

Figure 9:
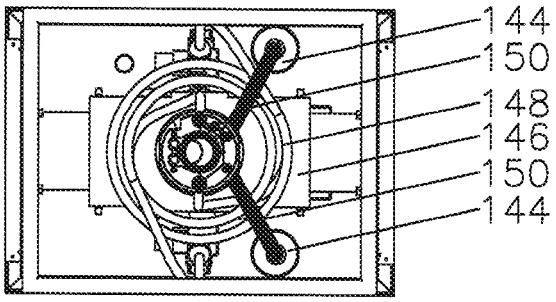
FIG. 9 is a top view of FIG. 8.

Referring now to FIG. 9, is a top view of seafloor drilling system 100.

Figure 10:
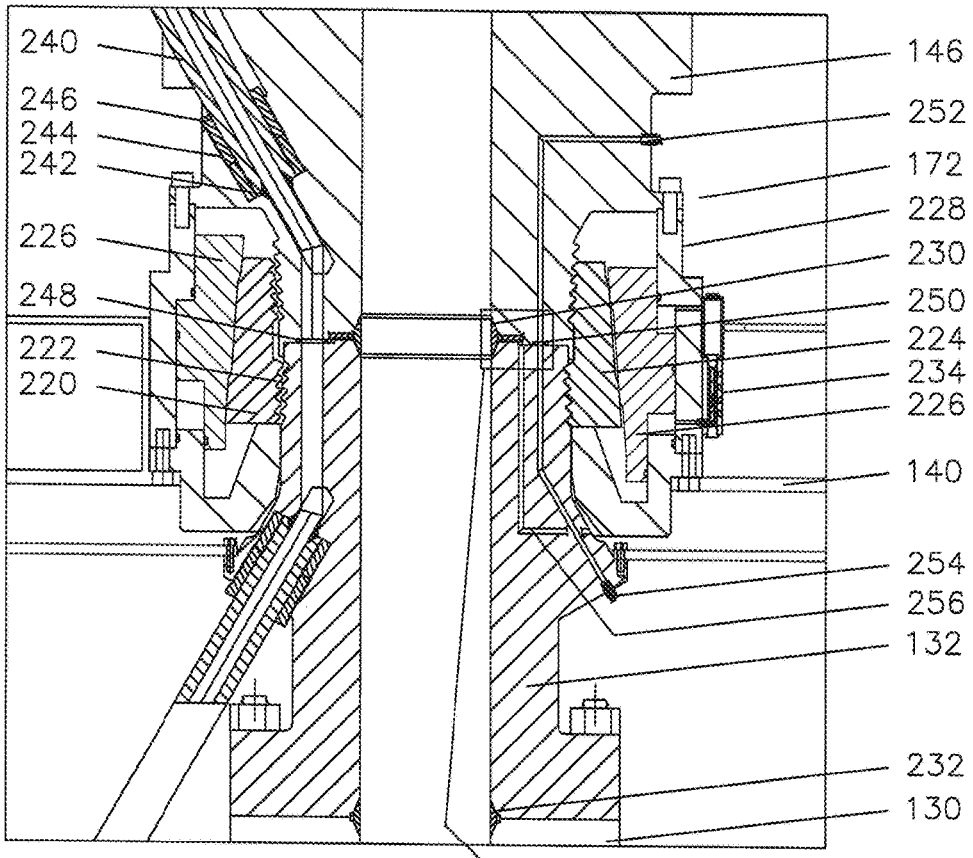
FIG. 10 is a figure generally taken from the box "10-10" from FIG. 7 showing a cross section of the connection between the lower marine riser package connector and the lower blowout preventer stack upper mandrel.

Referring now to FIG. 10 which is a figure generally taken from the box "10-10" from FIG. 7 showing the lower marine riser connector 172 connected to the upper mandrel 132 of the lower blowout preventer stack 102. A multiplicity of dogs 220 are shown disconnected from the upper mandrel profile 222 on the left side of the figure and are shown at 224 connected to the upper mandrel profile on the right side of the figure. This is affected by having ring shaped piston 226 in and upwardly position on the left side of the figure and in a more downwardly position on the right side of the figure. As the ring shaped piston moves downwardly, the multiplicity of dogs 220 are constricted about the upper mandrel 132.

Seal ring 230 sealingly engages the lower end of the annular blowout preventers 146 and the upper end of the upper mandrel 132. A similar seal ring 232 seals the upper end of the lower blowout preventer stack 130 and the lower end of the upper mandrel 132. Four input shuttle valve 234 receives input from the blue control pod, the yellow control pod, the acoustic control pod, and a remotely operated vehicle interface similar to 142 to give complete redundant control of the connector.

Choke and kill lines are connected by having a high pressure tube 240 have a sealing ring 242 engage its end and the main body, having a threaded ring 244 connected to the outer diameter of the tube and a gland nut 246 engaging the main body. Seal ring 248 is placed in the interface along the choke or kill line between the lower portion of the annular blowout preventer and the upper portion of the upper mandrel 132. By increasing the thickness of the upper portion of the upper mandrel 132 and porting the choke and kill lines through this section, the need for other choke and kill connectors along with their moment forces and alignment requirements are eliminated.

Similarly a multiplicity of seal rings 250 can be added for the porting of control lines through the same section from an inlet port 252 down to and outlet port 254. By utilizing this space, the need for separate stab plates for control pods is eliminated. One or more vent lines 256 can be added to vent any pressure buildups around these seals and keep them individually isolated.

Figure 11:
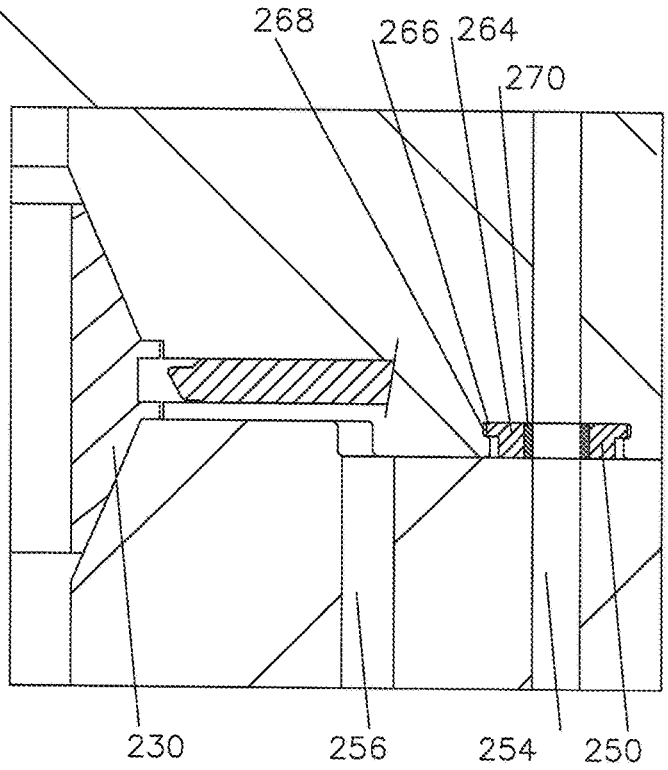
FIG. 11 is a portion of FIG. 10 showing the seal mechanism between the lower marine riser package and the lower blowout preventer stack.

Referring now to FIG. 11 which is a portion of FIG. 10. Packer seals 250 comprise a resilient seal material 264 having a protruding section 266 going into annular groove 268 for seal retention and an internal metal ring 270 for resisting external pressure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

SEQUENCE LISTING: N/A

That which is claimed is:

1. In a subsea blowout preventer stack system with a lower marine riser package with a lower marine riser connector and choke and/or kill lines, and a lower blowout preventer stack with a mandrel on an upper end and choke and/or kill lines connection to choke and kill valves, the mandrel having an external profile for engagement by the lower marine riser connector and an internal bore, a method of porting the choke and kill lines vertically through the p wall of the lower blowout preventer stack mandrel intermediate the external profile for engagement by the lower marine riser connector and the internal bore.

2. The method of claim 1, further comprising porting of the choke and kill lines vertically through the lower marine riser connector, the lower marine riser connector having an internal profile for engagement with the lower blowout preventer stack mandrel and an internal bore, the choke and kill lines being intermediate the internal profile and the internal bore.

3. The method of claim 2, further comprising vertically porting hydraulic control lines for the lower blowout preventer stack through the wall of the lower blowout preventer stack mandrel intermediate the external profile for engagement by the lower marine riser connector and the internal bore.

4. The method of claim 3, further comprising vertically porting the hydraulic control lines for the lower blowout preventer stack through the lower marine riser connector intermediate the internal profile for engagement by the lower blowout preventer stack mandrel and the internal bore.

5. The method of claim 4, further comprising one or more pockets are cut into the lower connector face around one or more of the choke and/or kill lines, the one or more pockets having an upper sealing surface, an outer surface, and one or more grooves in the outer surface.

6. The method of claim 5, further comprising one or more packer seals are placed in the one or more pockets, the packer seals having an upper sealing surface, a lower sealing surface, an external protrusion to engage the one or more grooves in the outer surface.

7. The method of claim 6, further comprising the one or more packer seals is molded to a ring to prevent extrusion of the packer seal into a bore of the one or more choke and/or kill porting or the one or more hydraulic control porting.

8. The method of claim 7, further comprising one or more vents ports area between the one or more packer seals and seal ring in a central bore of the blowout preventer system to prevent potential leakage on any of the one or more packer seals from imposing an external pressure on the seal ring.

9. In a subsea blowout preventer stack system with a lower marine riser package with a lower marine riser connector and choke and/or kill lines, and a lower blowout preventer stack with a mandrel on an upper end and choke and/or kill lines connection to choke and kill valves, the mandrel having an external profile for engagement by the lower marine riser connector and an internal bore a method of porting hydraulic control lines vertically through a wall of the lower blowout preventer stack mandrel intermediate the external profile for engagement by the lower marine riser connector and the internal bore.

10. The method of claim 9, further comprising porting of the hydraulic control lines vertically through the lower marine riser connector the lower marine riser connector having an internal profile for engagement with the lower blowout preventer stack mandrel and an internal bore, the choke and kill lines being intermediate the internal profile and the internal bore.

11. The method of claim 10, further comprising vertically porting the choke and/or kill lines for the lower blowout preventer stack through the wall of the lower blowout preventer stack mandrel intermediate the external profile for engagement by the lower marine riser connector and the internal bore.

12. The method of claim 11, further comprising vertically porting the choke and/or kill lines for the lower blowout preventer stack vertically through the lower marine riser connector intermediate the internal profile and the internal bore.

13. The method of claim 12, further comprising one or more pockets are cut into the lower connector face around one or more of the hydraulic control lines, the one or more pockets having an upper sealing surface, an outer surface, and one or more grooves in the outer surface.

14. The method of claim 13, further comprising one or more packer seals are placed in the one or more pockets, the packer seals having an upper sealing surface, a lower sealing surface, an external protrusion to engage the one or more grooves in the outer surface.

15. The method of claim 14, further comprising the one or more packer seals is molded to a ring to prevent extrusion of the packer seal into a bore of the one or more choke and/or kill porting or the one or more hydraulic control porting.

16. The method of claim 15, further comprising one or more vents ports area between the one or more packer seals and seal ring in a central bore of the blowout preventer system to prevent potential leakage on any of the one or more packer seals from imposing an external pressure on the seal ring.

17. The method of claim 9, further comprising vertically porting electrical lines for the lower blowout preventer stack through the wall of the lower blowout preventer stack mandrel intermediate the external profile for engagement by the lower marine riser connector and the internal bore.

* * * * *